US006175347B1

(12) United States Patent
Shindo et al.

(10) Patent No.: US 6,175,347 B1
(45) Date of Patent: Jan. 16, 2001

(54) LIQUID CRYSTAL DISPLAY APPARATUS

(75) Inventors: Yoshikuni Shindo, Sapporo; Hirokatsu Yui, Fujisawa; Hiromitsu Torii, Kamakura, all of (JP)

(73) Assignee: Matsushita Electric Industrial Co., Ltd. (JP)

( * ) Notice: Under 35 U.S.C. 154(b), the term of this patent shall be extended for 0 days.

(21) Appl. No.: 09/081,812

(22) Filed: May 21, 1998

(30) Foreign Application Priority Data

May 22, 1997 (JP) ..... 9-132075

(51) Int. Cl.[7] ..... G09G 5/00
(52) U.S. Cl. ..... 345/87; 345/112; 345/113
(58) Field of Search ..... 345/3, 112, 113, 345/87

(56) References Cited

U.S. PATENT DOCUMENTS

| | | | | |
|---|---|---|---|---|
| 5,034,814 | * | 7/1991 | Watson | 358/141 |
| 5,434,625 | * | 7/1995 | Willis | 348/564 |
| 5,699,535 | * | 12/1997 | Amro | 395/342 |
| 5,729,247 | * | 3/1998 | Shibasaki | 345/113 |
| 5,767,916 | * | 6/1999 | West | 348/537 |
| 5,790,096 | * | 8/1998 | Hill, Jr. | 345/150 |
| 5,801,780 | * | 9/1998 | Schaumont et al. | 348/441 |
| 5,805,233 | * | 9/1998 | West | 348/537 |
| 5,852,431 | * | 12/1998 | Ito | 345/145 |
| 5,914,753 | * | 6/1999 | Donovan | 348/441 |

FOREIGN PATENT DOCUMENTS

| | | |
|---|---|---|
| 0 519 744 A2 | 12/1992 | (EP) . |
| 0 519 744 A3 | 12/1992 | (EP) . |
| 0 707 305 A2 | 4/1996 | (EP) . |
| 0 707 305 A3 | 4/1996 | (EP) . |
| 7-219486 | 8/1995 | (JP) . |
| 10-26953 | 1/1998 | (JP) . |
| WO 92/20061 | 11/1992 | (WO) . |
| WO 96/10816 | 4/1996 | (WO) . |

* cited by examiner

*Primary Examiner*—William A. Cuchlinski, Jr.
*Assistant Examiner*—Marthe Y. Marc-Coleman
(74) *Attorney, Agent, or Firm*—Parkhurst & Wendel, LLP

(57) ABSTRACT

A/D converters (15–17), a PLL circuit (18), a scan conversion circuit (1), counters (4 and 5), an OR circuit (3), flip-flops (7–13) for comparing a phase of an output signal from the OR circuit (3) with a phase of an enable signal, and a CPU (14) are provided in a LCD apparatus so that settings in the scan conversion circuit (1), counter (4 and 5), and PLL circuit (18) can be changed responsive to outputs from the flip-flops (10–13), whereby a location and a size of a picture displayed on the LCD as well as a sampling clock frequency used in the A/D conversion can be automatically adjusted.

17 Claims, 8 Drawing Sheets

CLK

R'
U

Y
1024CLK

ENBP

ENBP2

ENBP2
HF=L, HB=L

HP

HP2

Y
768HP

VENB

VENB2

VENB2
VF=L, VB=L

LIQUID CRYSTAL DISPLAY APPARATUS

FIELD OF THE INVENTION

The present invention relates to a liquid crystal display (hereinafter referred to as LCD) apparatus having means for optimizing automatically a picture position and a picture size displayed on the LCD apparatus.

BACKGROUND OF THE INVENTION

In a video signal tapped off from a video signal source, e.g., a computer, a phase relation between a video signal and a synchronizing signal, i.e., a period between a horizontal synchronizing signal (herein after referred to as H. Sync. signal) and a leading edge of the video signal as well as a period between a vertical synchronizing signal (hereinafter referred to as V. Sync. signal) and a leading edge of the video signal, differs, in many cases, depending on the computer model. A picture location on the LCD thus differs depending on the type of computer.

Several prior art schemes addressed how to adjust the phase relation automatically when the video signal tapped off from the video signal source such as a computer, etc. is displayed on the LCD. One prior art method addressing this problem is disclosed in H07-219486,unexamined Japanese Patent Application Publication.

This prior art compares a phase relation between the video signal from the video signal source sliced at a predetermined level by a comparator with a LCD driving pulse generated from both of the H. Sync. signal and V. Sync. signal from the video signal source by using an AND circuit, and the comparison result is fed back to a central processing unit (CPU). Based on the comparison result, the CPU controls the phase of the LCD driving pulse, whereby a location of the picture on the LCD can be automatically adjusted.

This prior art aims to save time for adjusting and can be used as an adjusting tool such as an adjusting switch for a user to adjust a picture location on the LCD while watching a displayed picture.

The video signal tapped off from the video signal source such as a computer, etc., has various influencing factors other than the period between the H. Sync./V. Sync. signals and the leading edge of the video signal. Examples of the various influencing factors include a period until a trailing edge, scanning timing, horizontal scanning frequency, the number of scanning lines, the number of pixels, the dot clock frequency used in outputting the video signal, all of which may differ depending on the type of computer.

In a video signal tapped off from the video signal source such as a computer and the like, a number of effective pixels within one horizontal period and a number of effective scanning lines within a vertical period, in general, are not identical with a number of effective pixels and a number of effective scanning lines which a LCD can display. When the LCD apparatus simply provides the video signal tapped off from the video signal source with an analog-digital conversion (hereinafter referred to A/D conversion) and transmits the digital RGB signals into the LCD, the picture contained in the signal cannot be properly displayed on the LCD. (Hereinafter, the phrase "just scan" is used for describing a picture which contains a sufficient quantity of a video signal for proper display on an LCD.)

In order to just scan the LCD, the LCD apparatus must make a scan conversion for an input signal so that a number of pixels within one horizontal period and a number of scanning lines within one vertical period of the input video signal are identical with those numbers of the LCD.

To be responsive to such a variety of timing, the LCD apparatus must determine a phase of the LCD driving pulse so that a picture can be displayed at the center of the LCD display area, whereby "just scan", i.e., no conversion, is performed. Further, the LCD apparatus must determine an appropriate scan conversion rate responding to a timing of the signal source. (A scan rate=a number of pixels before conversion vs. that of after conversion, a number of effective scanning lines before conversion vs. that of after conversion.)

The conventional automatic adjustment of a picture location is only effective when the timing of the input signal source, in particular, the horizontal frequency is identical with the horizontal driving pulse which drives the LCD apparatus. In other words, the conventional method is only effective when no scan conversion is necessary. Namely, the conventional method can automatically adjust the picture location, but not adjust a picture size.

Even when the frequency of the driving pulse is the same as the scanning frequency of the input signal source, i.e., when the number of pixels of the input video signal is the same as the number of effective pixels of the LCD, picture quality is sometimes nevertheless lowered depending on a dot clock frequency that the computer uses for generating the video signal.

The dot frequency used for generating the video signal, in general, differs depending on the type of computer.

In order properly to display a picture on the LCD, the dot clock frequency must completely coincide with a LCD sampling clock frequency which is used in A/D conversion.

However, a conventional LCD apparatus does not have an automatic adjuster of the sampling clock frequency used in A/D conversion.

Since a variety of signal-source-timing is available in the conventional type of LCD apparatus, the scan conversion as well as determination of an optimal scan conversion rate is required for "just scan", however, the conventional LCD apparatus, in fact, cannot automatically adjust the picture location and size responding to a signal having an arbitrary timing.

In the conventional LCD apparatus, the dot clock frequency of the signal source cannot coincide with the sampling clock frequency used in the A/D conversion even when the signal does not require scan conversion.

Thus, a user must adjust the picture location, size and the sampling clock frequency while watching the conventional LCD in order to display a sufficient quantity of the video signal generated by various signal sources. This adjustment requires means for adjusting the picture location, size, and sampling clock frequency. As a result, a structure of operation means becomes complicated.

SUMMARY OF THE INVENTION

The present invention addresses the above problems and aims to provide a LCD apparatus which can automatically adjust a picture location and size as well as a sampling clock frequency and thereby be optimally responsive to a variety of timing.

The present invention provides a LCD apparatus having an adjusting method comprising the steps of:

(a) comparing digital RGB signals having undergone an A/D conversion, and a scan conversion when necessary, to be displayable on a LCD with a phase of an enable signal indicating a display period of the LCD apparatus, and generating a comparison result; and (b) responsive to that comparison result, adjusting automatically a picture location, its size and a sampling clock frequency in the A/D conversion by (i) changing a scan conversion rate, (ii) changing the phase of the enable signal, and (iii) changing the sampling clock frequency used in the A/D conversion.

DESCRIPTION OF THE PREFERRED EMBODIMENTS

Embodiment 1

The first exemplary embodiment is described by referring to FIGS. 1 to 7 and Table 1.

Figure 1:
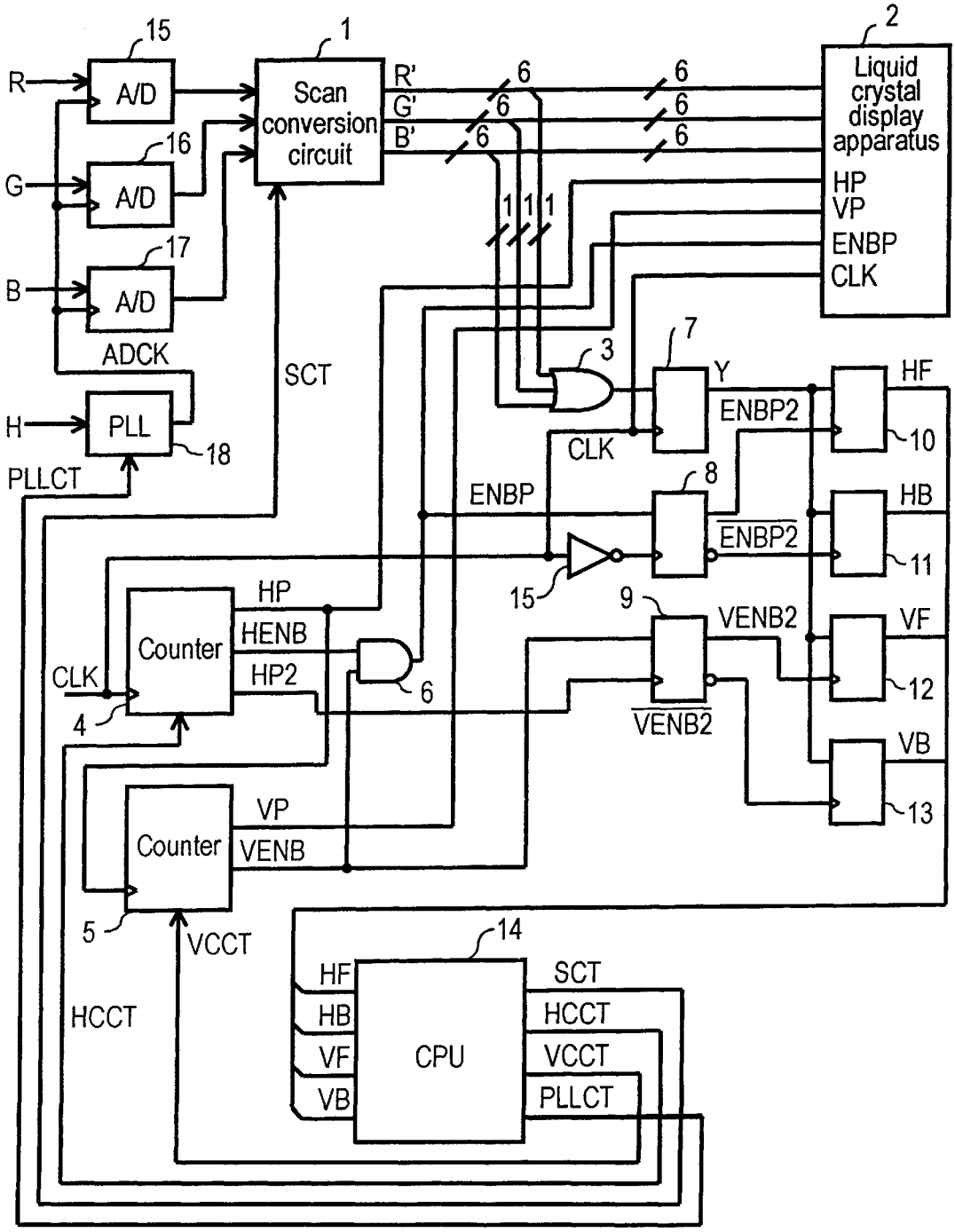
FIG. 1 depicts a LCD apparatus used in the first and second exemplary embodiments of the present invention.

In FIG. 1, input analog video RGB signals are tapped off from, for instance, an external computer or the like. The input analog RGB signals are converted into digital video signals by A/D converters 15, 16, and 17. A phase-locked loop (PLL) circuit 18 receives a H. Sync. signal H together with the analog video signal, and multiplies the H. Sync. signal H, thereby producing sampling clock signals ADCK to be fed into the A/D converter 15, 16 and 17. The multiplication factor is set by a control signal PLLCT produced by a microcomputer CPU 14.

A scan conversion circuit 1 converts a number of effective pixels within one horizontal period and a number of effective scanning lines of one vertical period of the input digital video signal into a number of effective pixels and effective scanning lines displayable in a LCD 2. The scan conversion rate, i.e., the ratio of a number of pixels (or scanning lines) before the conversion vs. a number of pixels (or scanning lines) after the conversion, is set by a control signal SCT output from the CPU 14.

The scan converted signals are named R', G' and B'. Each of these signal is a digital video signal consisting of 6 bits.

The LCD 2 displays R' G' and B', i.e., 6-bit digital video signal in color, which requires control signals such as H. Sync. signal HP, V. Sync. signal VP, an enable signal ENBP which becomes H level only during a display period of the LCD 2, and a clock signal CLK.

The frequency of the H. Sync. signal HP and the frequency of V. Sync. signal VP are not always identical with the H. Sync. frequency and V. Sync. frequency of the video signal source fed into the A/D converters 15–17. The reason why the scan conversion circuit 1 is placed between the signal source and the LCD 2 is that those signals do not coincide with each other.

When the enable signal ENBP stays at H level, the LCD 2 displays pictures. Therefore, when an output period of the digital signals R', G', and B' coincides with the period within which the enable signal ENBP stays at H level, a picture displayed on the LCD 2 is naturally optimized (just scanned.)

The frequency of the clock signal CLK applied to the LCD 2 can differ from that of the clock signal ADCK used in the A/D conversion sampling.

A logical OR circuit OR 3 determines the logical OR of the most significant bits of digital signals R', G', and B' output from the scan conversion circuit 1. The output signal from the OR 3 stays at H when any one of R, G, or B is displayed, and stays at L during the blanking period.

Counting the clock signal CLK which drives the LCD 2, a counter 4 produces a the H. Sync. signal HP to be fed into the LCD 2, a horizontal enable signal HENB which is a base of the enable signal ENBP and H. Sync. signal HP2 of which phase is shifted (e.g., delayed by ½ horizontal period phase) from the H. Sync. signal HP. A phase of each signal is set by a control signal HCCT tapped off from the CPU 14.

Counting the H. Sync. signal HP (H. Sync. signal to be fed into the LCD 2) produced by the counter 4, a counter 5 produces V. Sync. signal VP to be fed into the LCD 2 and a vertical enable signal VENB which is a base of the enable signal ENBP. A phase of each signal is set by a control signal VCCT tapped off from the CPU 14.

Taking a logical product AND made of multiplying the signal VENB produced in the counter 5 by the horizontal enable signal HENB produced in the counter 4, an AND circuit 6 produces the enable signal ENBP of the LCD 2. In other words, the AND circuit 6 outputs H only when both the horizontal enable signal HENB and vertical enable signal VENB stay at H. An output signal from the AND circuit 6 is the enable signal ENBP which sets a video display period of the LCD 2.

Next, flip-flops 7–13 are described. A flip-flop 7 synchronizes again with an output signal of the OR 3 (outputting H when any one of R, G, or B signal is displayed) at the leading edge of the clock signal CLK. An output signal from the flip-flop 7 is marked Y.

A flip-flop 8 and a NOT circuit 15 synchronize with the enable signal ENBP at a trailing edge of the clock signal CLK. A non-inverse output of the output signal from the flip-flop 8 is ENBP2 and an inverse output thereof is $\overline{\text{ENBP2}}$, thereby ENBP2 rises with a half cycle delay of CLK from ENBP.

A flip-flop 9 contributes to shift the vertical enable signal VENB which is a bass of the enable signal ENBP, and synchronizes with the vertical enable signal VENB at the leading edge of HP2. HP2 delays from HP by a half cycle of HP. A non-inverse output of an output signal from the flip-flop 9 is VENB2 and an inverse output thereof is $\overline{\text{VENB2}}$.

Flip-flops 10–13 synchronize the signal Y with ENBP2, $\overline{\text{ENBP2}}$, VENB2, and $\overline{\text{VENB2}}$ independently at their leading edge. The output signals thereof are HF, HB, VF, and VB respectively.

The CPU 14 changes the set-up of the following control signals responsive to results of output signals from the flip-flops 10–13: the control signal SCT of the scan conversion circuit 1, the control signals HCCT and VCCT of the counters 4 and 5, and the control signal PLLCT which control a multiplication of the PLL circuit 18.

Figure 2:
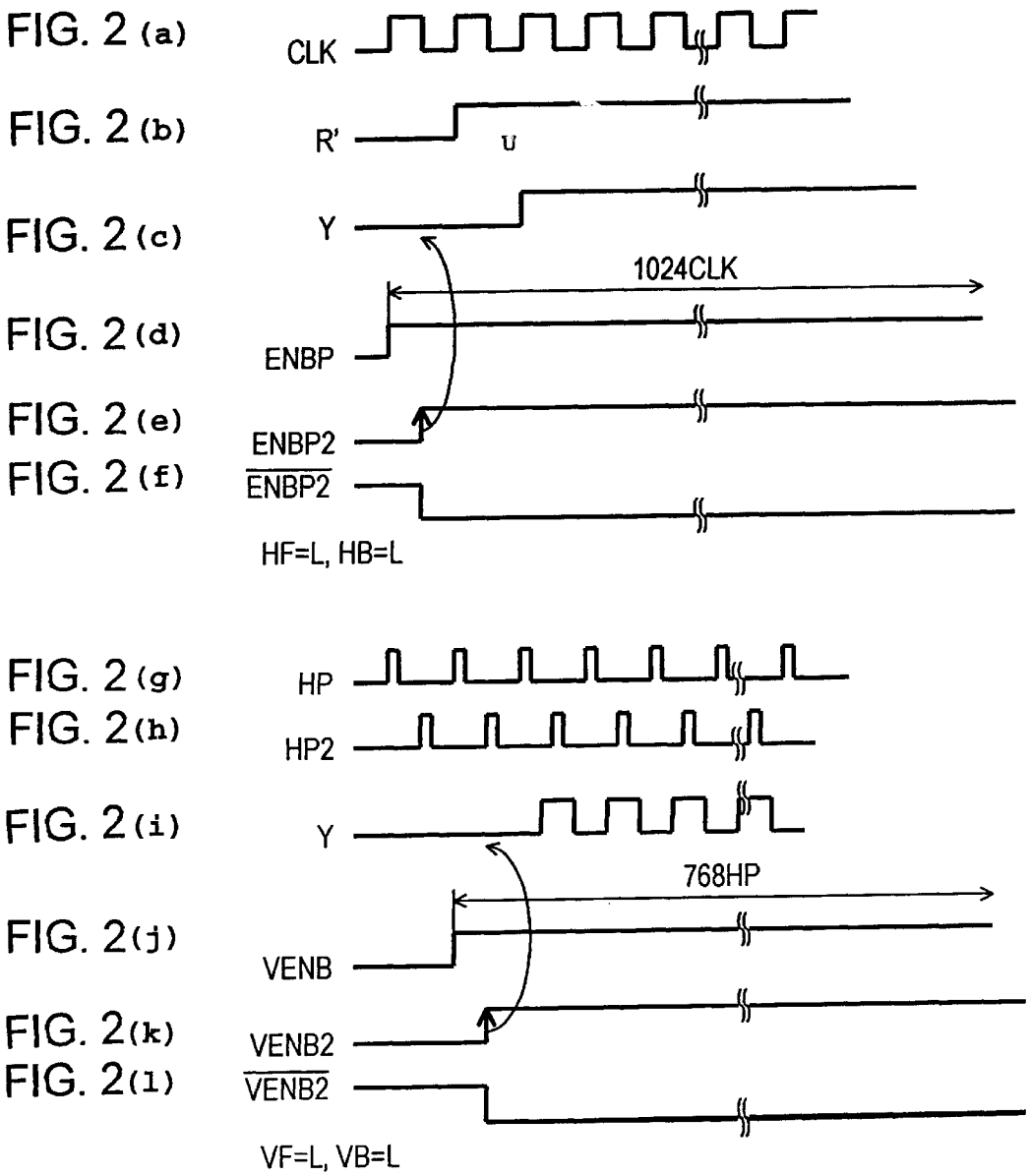
FIGS. 2(*a*)–(*l*) depict timing diagrams of each signal used in FIG. 1 of the present invention.

The following paragraphs, along with reference to FIGS. 2(*a*)–4(*l*) and Table 1, describe a picture location and size on the LCD, as well as relations between the location and size of the picture and the input signals HF, HB, VF, and VB to be fed into the CPU 14.

In the following description, the horizontal and vertical effective pixels of the LCD 2 are 1024 pixels and 768 lines. Accordingly, the periods of the enable signal ENBP indicating the display period of the LCD apparatus has an H period of 1024 clock pulses at the horizontal rate, and an H period of 768 lines at the vertical rate.

FIGS. 2(*a*)–(*l*) depict signal timings of HF, HB, VF, and VB when a displayed picture size is smaller than the maximum displayable size on the LCD 2 in both horizontal and vertical directions. In order to simplify the case, all input signals represent "white", whereby the output signals R', G' and B' tapped off from the scan conversion circuit 1 are shaped into the same wave-form. In this case, R' represents all three output signals to even further simplify the case.

The signal Y is, as described above, the output of the flip-flop 7 and synchronizes again with the output signal from the OR 3 (H period during which any one of R, G, or B is displayed) at the leading edge of CLK.

A horizontal timing wave-form is firstly described. The signal Y delays by one clock pulse with regard to the signal R', i.e., the signal Y rises and falls behind the signal R' by one clock pulse.

The signal ENBP2 delays by a half clock pulse with regard to the signal ENBP, and the signal $\overline{\text{ENBP2}}$ is shaped into an inverse wave-form of the signal ENBP2.

The signal HF is a latched signal of signal Y at the leading edge of the signal ENBP2, thus the signal HF always stays at L.

The signal HB as well, latches the signal Y at the leading edge of the signal $\overline{\text{ENBP2}}$, thus the signal HB stays always at L.

Next, the vertical timing wave-form is described. The signal HP2 delays by e.g., a half cycle of the signal HP with regard to the signal HP as illustrated in FIGS. 2(*g*) and (*h*).

The signal VENB2 latches the signal VENB at the leading edge of HP 2, and the signal $\overline{\text{VENB2}}$ is the inverse signal of the signal VENB2.

The signal VF latches the signal Y at the leading edge of the signal VENB2, thus the signal VF stays always at L.

The signal VB latches the signal Y at the leading edge of the signal $\overline{\text{VENB2}}$, thus the signal VB always remains at L.

Figure 3:
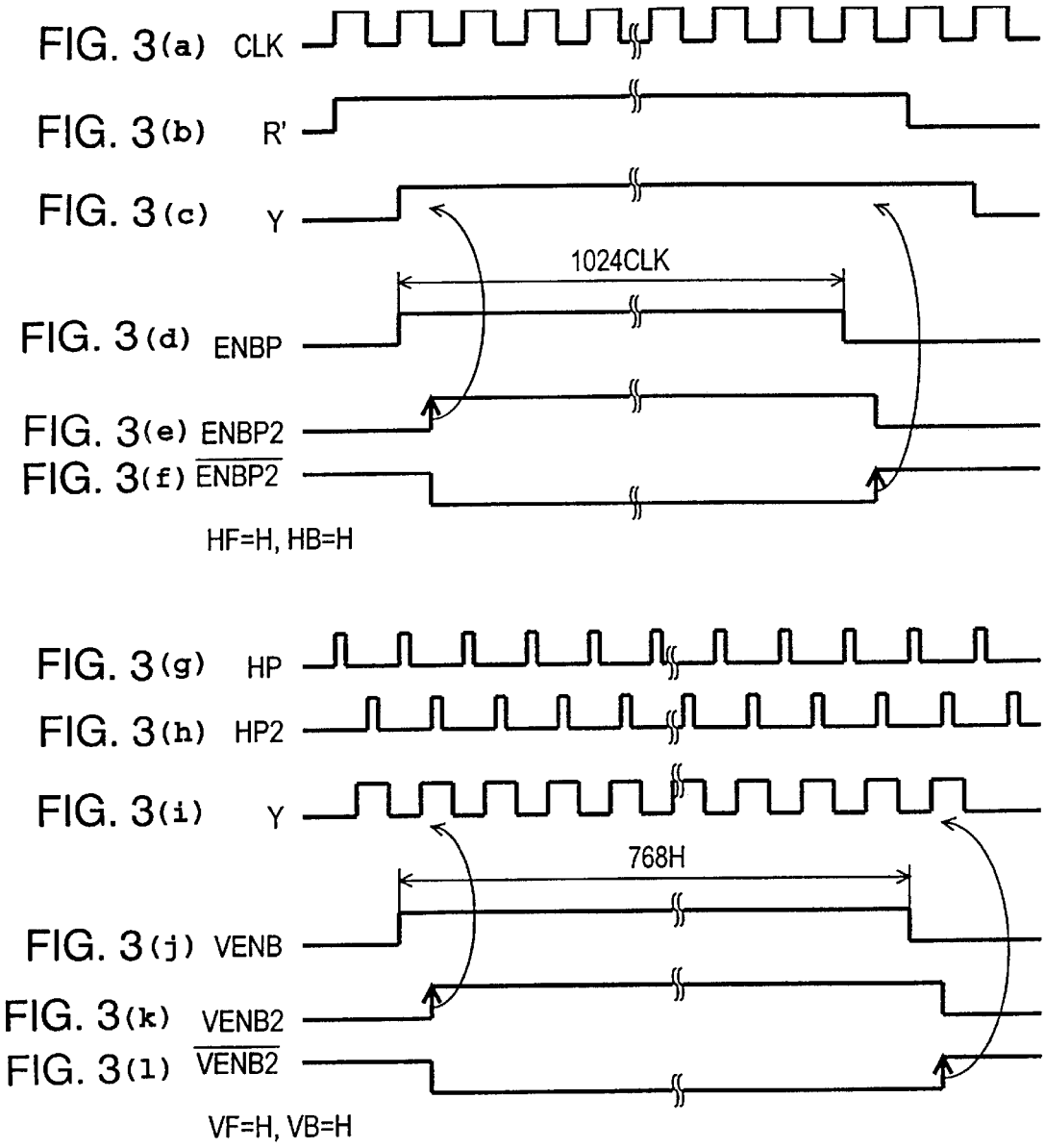
FIGS. 3(*a*)–(*l*) depict timing diagrams of each signal used in FIG. 1 of the present invention.

FIGS. 3(*a*)–(*l*) depict the signal timings of HF, HB, VF and VB when the displayed picture size is larger than the maximum displayable size on the LCD 2 in both horizontal and vertical directions. In order to simplify the case, all input signals in FIGS. 3(*a*)–(*l*) represent "white", thereby the signals HF, HB, VP, and VB become H.

Figure 4:
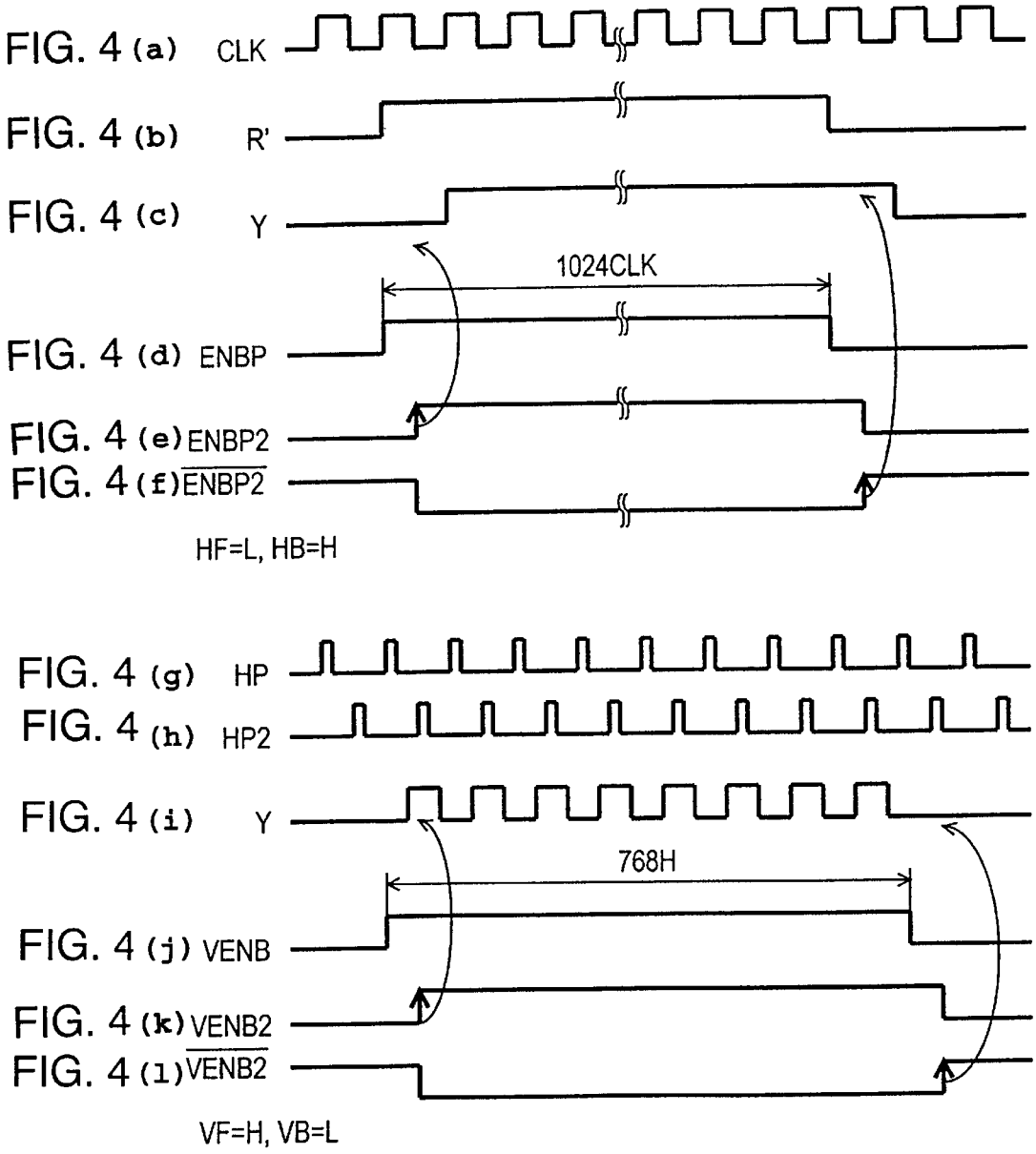
FIGS. 4(*a*)–(*l*) depict timing diagrams of each signal used in FIG. 1 of the present invention.

FIGS. 4(*a*)–(*l*) depict the signal timings of HF, HB, VF and VB when the displayed picture size on the LCD 2 is optimum both in horizontal and vertical directions (just scan.) In order to simplify the case, all input signals in FIG. 4 represent "white", thereby the signals are HF=L, HB=H, VF=H, and VB=L.

Table 1 summarizes the descriptions of FIGS. 2–4, and depicts correlation between the detected signals HF, HB, VF, VB and the display status according to this first exemplary embodiment.

Figure 5:
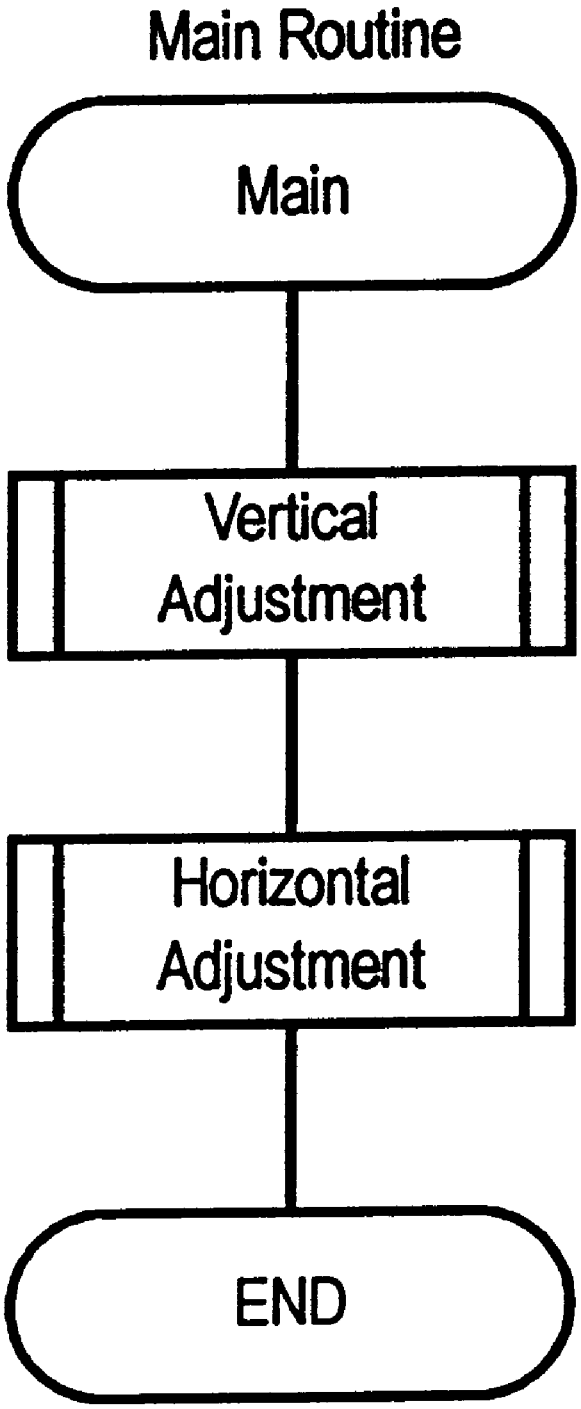
FIG. 5 is a control flow chart (main) of the first and second exemplary embodiments according to the present invention.
Figure 6:
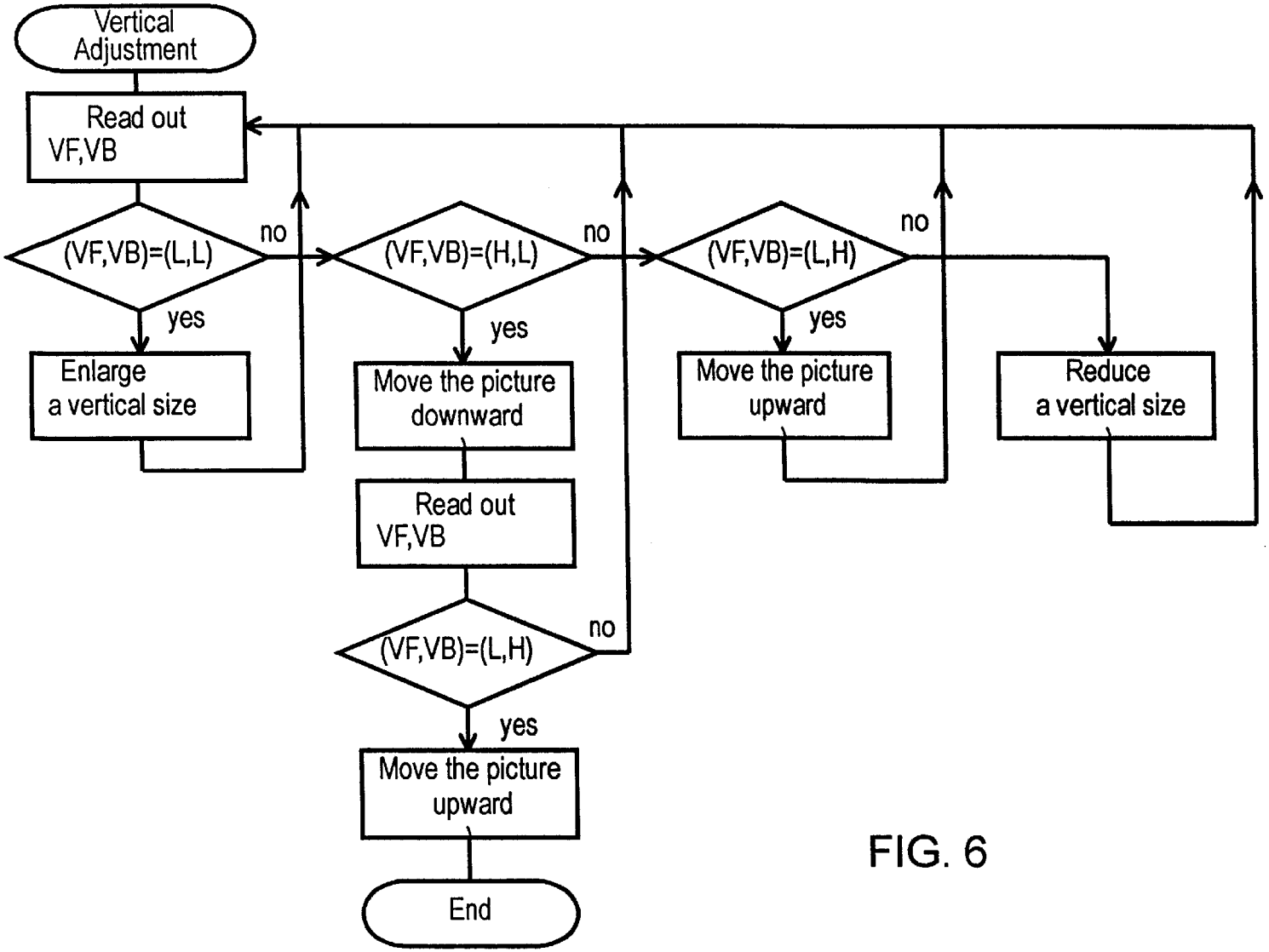
FIG. 6 is a control flow chart (vertical adjustment) of the first and second exemplary embodiments according to the present invention.
Figure 7:
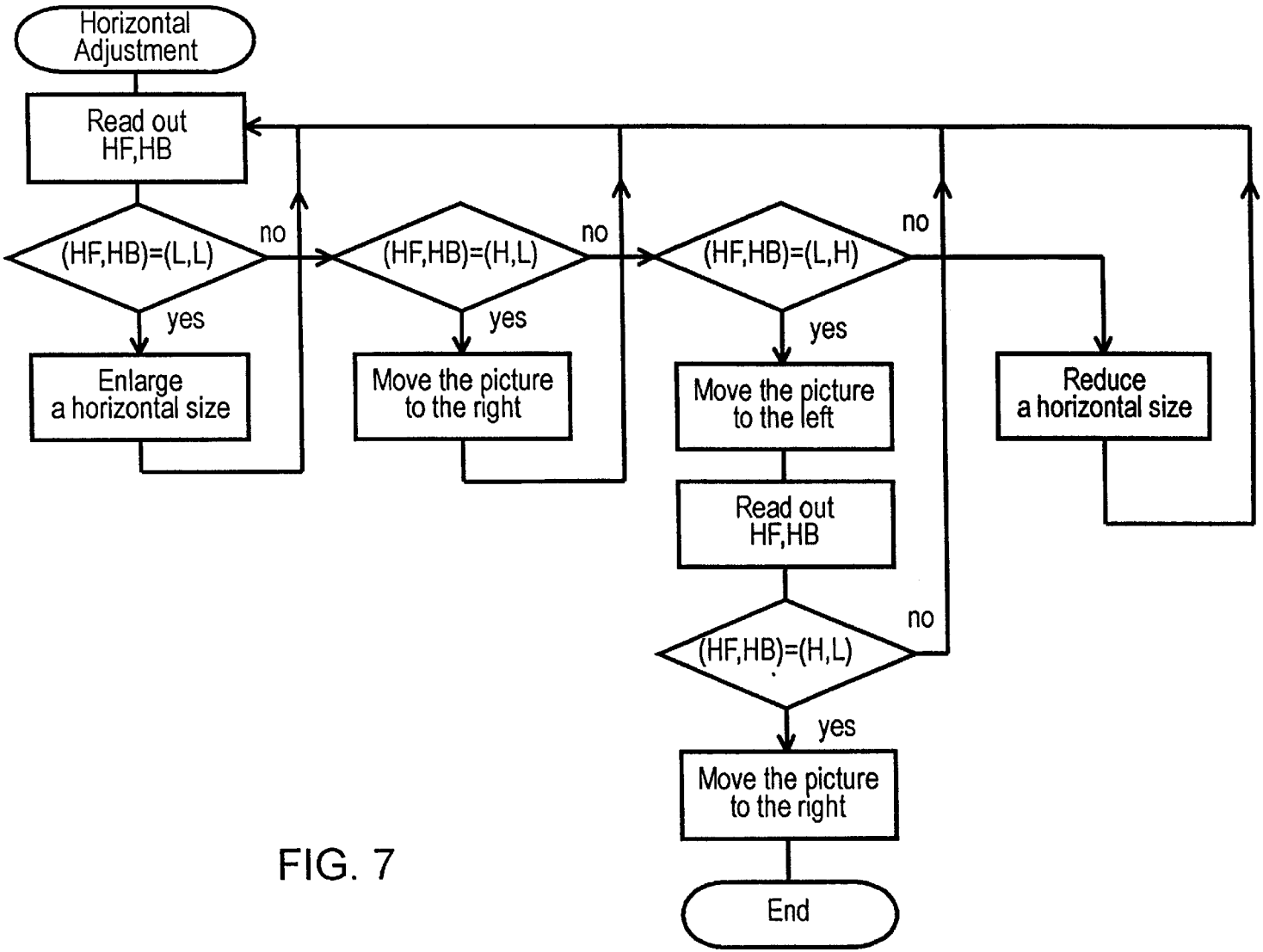
FIG. 7 is a control flow chart (horizontal adjustment) of the first and second exemplary embodiments according to the present invention.

One of the processes of CPU 14 in automatically adjusting the picture location and size is described by referring to FIGS. 5–7.

In this exemplary embodiment, a number of pixels (horizontal direction) on one scanning line and a number of scanning lines (vertical direction) of a picture output from the signal source are different from those displayable numbers of LCD 2.

Therefore, the horizontal and vertical sizes are controlled by changing the conversion rate of the scan conversion circuit 1.

A frequency dividing rate of the PLL circuit 18 can be arbitrarily set for the first time.

FIG. 5 is a main part of a flow chart depicting a process of automatically adjusting a picture location and size. In this exemplary embodiment, as shown in FIG. 5, vertical location and size of a displayed picture are optimized first, however; horizontal location and size can be optimized before the vertical optimization.

TABLE 1

| |
|---|
| In the case of (HF, HB) = (L, L), |
| status of the present picture: |
| a horizontal size is small |
| process to be taken next: |
| enlarging the horizontal size |
| In the case of (HF, HB) = (H, L), |
| status of the present picture: |
| a picture is shifted horizontally to the left |
| process to be taken next: |
| move the picture horizontally to the right |
| In the case of (HF, HB) = (L, H), |
| status of the present picture: |
| a picture is shifted horizontally to the left, |
| or the picture is at an optimal location |
| process to be taken next: |
| move the picture horizontally to the left, |
| or finish the process |
| In the case of (HF, HB) = (H, H), |
| status of the present picture: |
| a horizontal size is large |
| process to be taken next: |
| reduce the horizontal size |
| In the case of (VF, VB) = (L, L), |
| status of the present picture: |
| a vertical size is small |
| process to be taken next: |
| enlarge the vertical size |
| In the case of (VF, VB) = (H, L), |
| status of the present picture: |
| the picture is shifted upward or is in |
| the optimum location |
| process to be taken next: |
| move the horizontal location downward, |
| or finish the process |
| In the case of (VF, VB) = (L, H), |
| Status of the present picture: |
| the picture is shifted downward |
| process to be taken next: |
| move the vertical location upward |
| In the case of (VF, VB) = (H, H), |
| Status of the present picture: |
| the vertical size is large |
| process to be taken next: |
| reduce the vertical size |

FIG. 6 is a flow chart depicting an automatic adjustment of a picture location and a size in vertical direction. In this adjustment, since the information about only the vertical direction is necessary, HF and HB are not needed, and VF and VB should be read out. Since the relation between the status of VF and VB and the status of the present picture is described in Table 1, a process of inverting the picture status should be taken.

For instance, in the case of (VF, VB)=(L, L), the vertical size of the present picture is small according to Table 1, the process of enlarging the vertical size should be thus taken as described in FIG. 6. Specifically, the scan conversion rate in vertical direction should be changed by the control signal SCT fed into the scan conversion circuit 1 from the CPU 14 as shown in FIG. 1.

In the case of (VF, VB)=(H, L), because the picture status regarding the vertical direction could be at the optimal location according to Table 1, the picture is moved downward intentionally to force the picture "too downward" as described in FIG. 6, and then the picture is moved upward before finishing the process.

The moving of the picture upward and downward is controlled by the control signal VCCT fed into the counter 5 from the CPU 14 as illustrated in FIG. 1. In other words, the phases of the signals VP and VENB are shifted independently of the signal R', G' and B' to be fed into the LCD 2.

FIG. 7 is a flow chart depicting the automatic adjustment of the picture location and the size in a horizontal direction. In this adjustment, since the information about only the horizontal direction is necessary, VF and VB are not needed, and HF and HB should be read out. Since the relation between the status of HF and HB and the status of the present picture is described in Table 1, a process of inverting the picture status should be taken.

For instance, in the case of (HF, HB)=(L, L), the horizontal size of the present picture is small according to Table 1, the process of enlarging the horizontal size should be thus taken as described in FIG. 7. Specifically, the scan conversion rate in the horizontal direction should be changed by the control signal SCT fed into the scan conversion circuit 1 from the CPU 14 as described in the vertical case.

In the case of (HF, HB)=(L, H), because the picture status could be at the optimal location according to Table 1, the picture is moved to the left intentionally to make sure that the picture is "too leftward" as described in FIG. 7, and then the picture is moved to the right before the process is finished.

The moving of the picture to both sides is controlled by the control signal HCCT fed into the counter 4 from the CPU 14. The picture is moved to both sides by shifting the phases of the signals HP, HENB and HP2 at the same time and by the same quantity.

Embodiment 2

The second exemplary embodiment of the present invention is described by referring to FIGS. 1, 5, 6 and 8, as well as Table 2. The same description detailed in the first exemplary embodiment is omitted. In this embodiment, the number of effective pixels and the number of effective scanning lines of the input signal source are identical with those numbers of the LCD 2. The scan conversion in the horizontal and vertical directions are thus not necessary. Accordingly, the scan conversion rate of the scan conversion circuit 1 is set to "1" in both the directions by the control signal SCT from the CPU 14. In the following descriptions, the numbers of effective elements of the LCD 2 in FIG. 1 are 1024 pixels in horizontal and 768 scanning lines in vertical direction. The enable signal ENBP indicating the display period of the LCD apparatus has an H period of 1024 clock pulses at the horizontal rate and an H period of 768 lines at the vertical rate.

Table 2 describes the relations among the signals HF, HB, VF, VB, and the picture location as well as a sampling clock frequency. This embodiment handles only the timing that does not require scan conversion, and thus when a video signal which can cover the whole screen with a picture is input, (VF, VB) shall be neither (L, L) nor (H, H.)

In the case of (HF, HB)=(L, L), in other words, when a horizontal picture size is detected to be smaller than the description in Table 2, the frequency of the sampling clock ADCK in the A/D conversion is lower than the dot clock frequency of the signal source. Because, e.g., when a number of the dot clocks per horizontal period of the signal source is 1200, and among them the effective display area is 1024, if a division rate of the PLL 18 per horizontal period is 1100, lower than 1200, approximately 938 samples are effective display area (1100×1024/1200≈938).

Since the LCD 2 has 1024 pixels in the horizontal direction, a portion covered by 86 pixels is a blanking area (1024−938=86.) When a user watches this picture status, the horizontal size seems small. In the case of (HF, HB)=(H, H), in other words, the horizontal picture size is detected larger than the description in Table 2, the sampling clock frequency is, on the contrary to the above case, higher than the dot clock frequency of the signal source.

TABLE 2

| |
|---|
| In the case of (HF, HB) = (L, L), |
| status of the present picture: |
| a horizontal size is small = the sampling clock frequency is low |
| process to be taken next: |
| raise the multiplication factor of PLL |
| In the case of (HF, HB) = (H, L), |
| status of the present picture: |
| a picture is shifted horizontally to the left |
| process to be taken next: |
| move the picture horizontally to the right |
| In the case of (HF, HB) = (L, H), |
| status of the present picture: |
| a picture is shifted horizontally to the right or the picture is at an optimal location |
| process to be taken next: |
| move the picture horizontally to the left, or finish the process |
| In the case of (HF, HB) = (H, H), |
| status of the present picture: |
| a horizontal size is large = the sampling clock frequency is high |
| process to be taken next: |
| lower the multiplication factor of PLL |
| In the case of (VF, VB) = (L, L), |
| status of the present picture: |
| not available |
| process to be taken next : — |
| In the case of (VF, VB) = (H, L), |
| status of the present picture: |
| the picture is shifted upward or is in the optimum location |
| process to be taken next: |
| move the horizontal location downward, or finish the process |
| In the case of (VF, VB) = (L, H), |
| status of the present picture: |
| the picture is shifted downward |
| process to be taken next: |
| move the vertical location upward |
| In the case of (VF, VB) = (H, H), |
| status of the present picture: |
| not available |
| process to be taken next : — |

Figure 8:
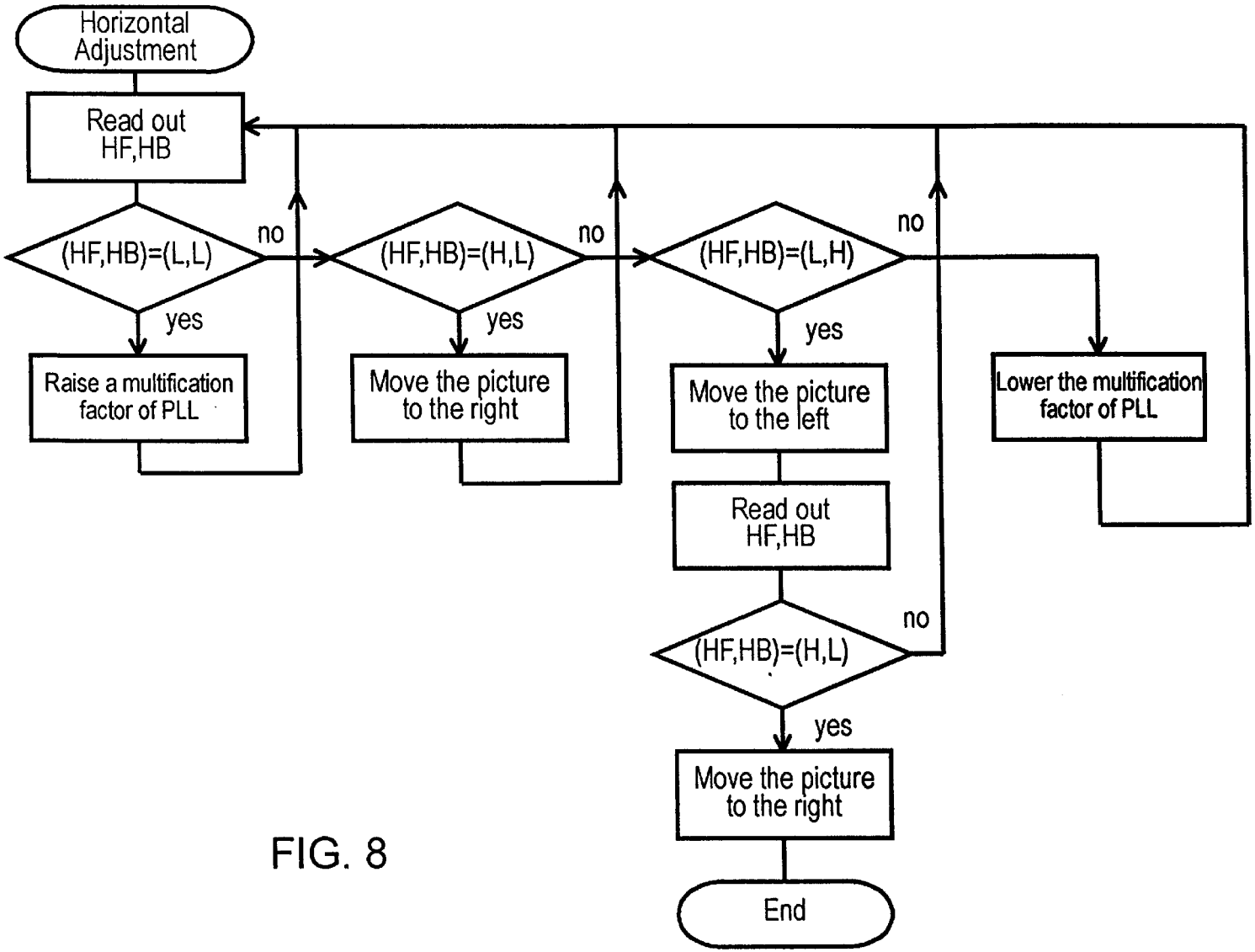
FIG. 8 is a control flow chart (horizontal adjustment) of the second exemplary embodiment of the present invention.

By referring to FIGS. 5, 6 and 8, the process of automatic adjustment in this second exemplary embodiment is described.

In this embodiment, the vertical direction is firstly adjusted, then the horizontal direction is adjusted. The main point of the process is identical with that of the first exemplary embodiment shown in FIG. 5, and FIG. 6 of the first embodiment can be applicable to the vertical adjustment. However, in this second embodiment, (VF, VB) never becomes (L, L) or (H, H.)

FIG. 8 depicts a process of the horizontal adjustment assigned to the CPU 14 in this embodiment. This process differs from that shown in FIG. 7 of the first embodiment in the following point: The horizontal direction is adjusted not by changing the set in the scan conversion circuit 1, but by changing the multiplication factor of the PLL circuit 18.

In accordance with the present invention there is provided an automatic adjustment circuit for a picture location and size, without reliance on any information about an input signal (a number of effective pixels, H. and V. Sync. frequencies, and dot clock frequency.) The automatic adjustment circuit according to the present invention is operable with a variety of timing schemes, and adjusts automatically the picture location, size, and the sampling clock frequency used in the A/D conversion so that "just scan" can be performed in displaying a picture on the LCD.

What is claimed is:

1. A liquid crystal display apparatus for automatically adjusting a location and a size of a picture displayed on a liquid crystal display of said liquid crystal display apparatus comprising:

means for comparing a phase of an input video signal that has undergone a scan conversion with a phase of an enable signal indicating a display period of said liquid crystal display, and determining a comparing result; and means for changing in accordance with said comparing result a conversion rate of said scan conversion and the phase of said enable signal.

2. The liquid crystal display apparatus of claim 1 further comprising:

an analog/digital converter for converting an input video signal from an analog form to a digital form;

a phase-locked loop circuit for producing a sampling clock used in said analog/digital converter;

a scan conversion circuit for converting a number of dots per horizontal period of the input video signal and a number of lines per vertical period of the input video signal;

a plurality of counters for generating an enable signal indicating a display period of said liquid crystal display;

a plurality of flip-flops for comparing a phase of digital video signal that has undergone a scan conversion at said scan conversion circuit and a phase of said enable signal; and a central processing unit, wherein said central processing unit changes responsive to an output from said plurality of flip-flops 1) a conversion rate of said scan conversion circuit, 2) a multiplication factor of said phase-locked loop circuit, and 3) a counting condition of said plurality of counters to change a phase of said enable signal.

3. The liquid crystal display apparatus as defined in claim 2, wherein the phase of said digital video signal that has undergone a scan conversion and the phase of said enable signal are compared when said video signal that has undergone a scan conversion at said scan conversion circuit includes RGB signals in a digital form, said liquid crystal display apparatus further comprising an OR circuit for calculating OR of significant bits including the most significant bits of each of said RGB signals, wherein said liquid crystal display apparatus compares the phase of an output signal from said OR circuit with the phase of said enable signal.

4. The liquid crystal display apparatus of claim 2, wherein the phase of said digital video signal that has undergone a scan conversion and the phase of said enable signal are compared when said video signal that has undergone a scan conversion at said scan conversion circuit includes RGB signals in a digital form, said liquid crystal display apparatus further comprising:

an OR circuit for calculating OR of significant bit of each of said RGB signals, wherein said liquid crystal display apparatus compares the phase of an output signal from said OR circuit with the phase of said enable signal.

5. The liquid crystal display apparatus as defined in claim 1, further comprising:

a scan conversion circuit for converting a number of dots per horizontal period of the input video signal and a number of lines per vertical period of the input video signal; and an enable signal generation circuit for generating an enable signal indicating a display period of said liquid crystal display.

6. The liquid crystal display apparatus as defined in claim 5, wherein said enable signal generation circuit comprises a plurality of counters and an AND circuit, said enable signal generation means generates an enable signal indicating a display period of said liquid crystal display; and said means for comparing comprises a plurality of flip-flops, said means for comparing compares of phase of a video signal that has undergone a scan conversion with a phase of said enable signal.

7. The liquid crystal display apparatus as defined in claim 5, further comprising:

an analog/digital converter for converting an input video signal from an analog form to a digital form;

a phase-locked loop circuit for generating a sampling clock used in said analog/digital converter; and a central processing unit, wherein said central processing unit changes responsive to an output from said plurality of flip-flops 1) a conversion rate of said scan conversion circuit, 2) a multiplication factor of said phase-locked loop circuit, and 3) a counting condition of said plurality of counters in order to change a phase of said enable signal.

8. The liquid crystal display apparatus as defined in claim 5, wherein a phase of a digital video signal that has undergone a scan conversion and a phase of said enable signal are compared when said video signal that has undergone a scan conversion at said scan conversion circuit includes RGB signals in a digital form.

said liquid crystal display apparatus further comprising:

an OR circuit for calculating OR of significant bits including the most significant bits of each of said RGB signals, wherein said liquid crystal display apparatus compares a phase of an output signal from said OR circuit with the phase of said enable signal.

9. The liquid crystal display apparatus as defined in claim 5, wherein a phase of digital video signal that has undergone a scan conversion and a phase of said enable signal are compared when said video signal that has undergone a scan conversion at said scan conversion circuit includes RGB signals in a digital form, said liquid crystal display apparatus further comprising:

an OR circuit for calculating OR of the most significant bits of each of said RGB signals, wherein said liquid crystal display apparatus compares the phase of an output signal from said OR circuit with the phase of said enable signal.

10. A liquid crystal display apparatus comprising:

means for comparing a phase of digital RGB signals with a phase of an enable signal indicative of a display period of a liquid crystal display; and means for adjusting a sampling clock frequency responsive to a result output from said means for comparing such that said sampling clock frequency which is used in an analog/digital conversion from analog RGB signals to digital RGB signals coincides with a dot clock frequency that produced said analog RGB signals.

11. The liquid crystal display apparatus of claim 10 further comprising:

an analog/digital converter for converting analog RGB signals produced in a signal source to digital RGB signals;

a phase-locked loop circuit for producing a sampling clock of said analog/digital converter;

a plurality of counters for producing an enable signal indicative of a display period of said liquid crystal display;

an OR circuit for finding OR of the most significant bit of each of said digital RGB signals;

a plurality of flip-flops for comparing phases of an output signal from said OR circuit with a phase of said enable signal; and a central processing unit for changing, in response to an output from said plurality of flip-flops, a multiplication factor of said phase locked loop circuit.

12. A liquid crystal display apparatus for automatically adjusting a location and a size of a picture displayed on a liquid crystal display of said liquid crystal display apparatus comprising:

an analog/digital converter for converting input analog RGB signals to digital RGB signals;

a phase-locked loop circuit for generating a sampling clock signal for supplying to said analog/digital converter;

an OR circuit for calculating OR of the most significant bits of each of said digital RGB signals;

means for comparing a phase of an output signal from said OR circuit with a phase of an enable signal indicating a display period of said liquid crystal display; and means for adjusting a sampling clock signal frequency output from said phase-locked loop circuit responsive to an output signal from said means for comparing so that the frequency and phase of the sampling clock signal which is used in said analog/digital conversion circuit coincides with a frequency and phase of a dot clock that produced said analog RGB signals.

13. The liquid crystal display apparatus as defined in claim 12, wherein said means for comparing comprises a plurality of flip-flops, said liquid crystal display apparatus further comprising:

a plurality of counters for generating an enable signal indicating a display period of said liquid crystal display; and a central processing unit for changing a multiplication factor of said phase-locked loop circuit responsive to an output from said plurality of flip-flops.

14. A method for automatically adjusting a location and a size of a picture displayed on a liquid crystal display of a liquid crystal display apparatus comprising:

performing a scan conversion for an input video signal at a predetermined conversion rate;

comparing a phase of said video signal that has undergone a scan conversion with a phase of an enable signal indicating a display period of said liquid crystal display; and controlling a conversion rate of said scan conversion, a multiplication factor of a phase-locked loop circuit, and a phase of said enable signal responsive to a result of said step of comparing.

15. The method for automatically adjusting a location and a size of a picture displayed on a liquid crystal display of a liquid crystal display apparatus as defined in claim 14, further comprising:

converting an input video signal from an analog form to a digital form;

converting a number of dots per horizontal period of the input video signal that has undergone an analog/digital conversion and a number of lines per vertical period of the input video signal at a predetermined conversion rate;

generating an enable signal indicating a display period of said liquid crystal display using a plurality of counters, an AND circuit, and a central processing unit; and comparing a phase of said converted input video signal and a phase of said enable signal using a plurality of flip-flops.

16. The method for automatically adjusting a location and a size of a picture displayed on a liquid crystal display of a liquid crystal display apparatus as defined in claim 14, further comprising:

calculating OR of significant bits including the most significant bits of each of said RGB signals when digital video signal converted by said scan conversion circuit includes RGB signals; and comparing a phase of OR output signal in the step of calculating OR with a phase of said enable signal.

17. The method for automatically adjusting a location and a size of a picture displayed on a liquid crystal display of a liquid crystal display apparatus as defined in claim 14, further comprising:

changing responsive to an output from said plurality of flip-flops 1) a conversion rate of said scan conversion circuit, 2) a multiplication factor or said phase-locked loop circuit, and 3) a counting condition of said plurality of counters in order to change a phase of said enable signal.

* * * * *